US006806854B2

(12) United States Patent
Cairns et al.

(10) Patent No.: US 6,806,854 B2
(45) Date of Patent: Oct. 19, 2004

(54) DISPLAY

(75) Inventors: Graham Andrew Cairns, Oxford (GB); Michael James Brownlow, Oxford (GB)

(73) Assignee: Sharp Kabushiki Kaisha, Osaka (JP)

( * ) Notice: Subject to any disclaimer, the term of this patent is extended or adjusted under 35 U.S.C. 154(b) by 148 days.

(21) Appl. No.: 09/946,102

(22) Filed: Sep. 4, 2001

(65) Prior Publication Data

US 2002/0030653 A1 Mar. 14, 2002

(30) Foreign Application Priority Data

Sep. 14, 2000 (GB) ..... 0022509

(51) Int. Cl.[7] ..... G09G 3/36

(52) U.S. Cl. ..... 345/87; 345/55; 345/90; 345/98; 345/100; 345/559; 345/560; 349/41; 348/790; 348/792

(58) Field of Search ..... 345/87, 90, 92, 345/55, 61, 98, 204, 559, 560, 94; 349/41; 348/790, 792

(56) References Cited

U.S. PATENT DOCUMENTS

| | | | | |
|---|---|---|---|---|
| 5,170,158 A | * | 12/1992 | Shinya | 345/98 |
| 5,287,095 A | | 2/1994 | Kitazima et al. | 345/99 |
| 5,510,807 A | | 4/1996 | Lee et al. | 345/103 |
| 5,670,979 A | | 9/1997 | Huq et al. | 345/100 |
| 5,754,157 A | * | 5/1998 | Kuwata et al. | 345/100 |
| 6,211,851 B1 | * | 4/2001 | Lien et al. | 345/89 |
| 6,455,360 B1 | * | 9/2002 | Miyasaka | 438/166 |
| 6,481,000 B1 | * | 11/2002 | Zaveri et al. | 716/17 |
| 6,535,325 B2 | * | 3/2003 | Helsel et al. | 359/291 |

FOREIGN PATENT DOCUMENTS

| | | |
|---|---|---|
| EP | 0 458 169 A3 | 11/1991 |
| EP | 0 458 169 A2 | 11/1991 |
| EP | 0760508 | 3/1997 |
| EP | 0 837 446 A1 | 4/1998 |
| EP | 0 929 064 A1 | 7/1999 |
| EP | 0 938 074 A1 | 8/1999 |
| JP | 08-137446 | 5/1996 |
| JP | 10-097229 | 4/1998 |

OTHER PUBLICATIONS

European Search Report, Application No. EP 01 30 7746, mailed Jan. 23, 2003.

* cited by examiner

*Primary Examiner*—Xiao Wu
*Assistant Examiner*—Abbas Abdulselam
(74) *Attorney, Agent, or Firm*—Renner, Otto, Boisselle & Sklar, LLP

(57) ABSTRACT

An active matrix display comprises an active matrix 1 and a digital data driver 30 formed on a common substrate 100 by a common integration process. The driver 30 comprises a serial to parallel converter 20 having m registers forming at least one set for storing display data for m picture elements, where m is less than the number M of data lines of the matrix 1. The outputs of the registers are connected to m digital/analogue converters 21 whose outputs are connected to m bus lines 50 of an m phase analogue driver 22 in the form of a switching network. The switching network connects in turn groups of m physically adjacent data lines of the matrix 1 to the m bus line, respectively.

18 Claims, 13 Drawing Sheets

DISPLAY

BACKGROUND OF THE INVENTION

1. Field of the Invention

The present invention relates to an active matrix display. In this context, the term "display" includes not only devices intended to be viewed directly by a viewer but also devices for generating or modulating light for other purposes, for example optical processing. Thus, active or light-generating and passive or light-varying spatial light modulators are encompassed by the term "display" herein.

2. Description of the Related Art

FIG. 1 of the accompanying drawings illustrates a typical known type of active matrix display comprising an active matrix 1 of N rows and M columns of picture elements (pixels). The display comprises a data line driver 2 for receiving data at an input 3 and for supplying analogue data voltages to electrodes, such as 4, of liquid crystal pixels via data lines, such as 5. Each pixel comprises a TFT 6 which is connected between the pixel electrode 4 and the respective data line 5 so that columns of pixels are connected to common data lines. The gates of the transistors 6 are connected to scan lines 7 in rows with each scan line being connected to a scan line driver 8 which enables each row of pixels in turn for refreshing of a display row or line.

The data line driver 2 may receive analogue video data or digital video data. In the case of digital video data, the data line driver performs digital/analogue conversion so as to convert the incoming pixel display data to a voltage suitable for application to the pixels in order to display the desired image. The digital/analogue conversion may be non-linear so as to compensate for the generally non-linear liquid crystal voltage/light transmission characteristics.

There are several difficulties to overcome in order to integrate the circuitry such as the data line driver 2 monolithically on the same substrate as the active matrix. These difficulties generally increase with increasing required frequency of operation of the data line driver 2 and arise from: the relatively low semiconductor performance of polysilicon transistors; and integration density Which is limited by the lithographic resolution achievable over a large substrate area. These factors set limits on the complexity of the data line driver before operating frequency, circuit area and power consumption become problematic Digital display data are typically supplied to the digital data driver in serial form. The data are segmented into groups, generally referred to as lines of data, with each line of data corresponding to one of the N rows of pixels in the active matrix 1. Starting with the top row of pixels in the matrix 1, the data are input line by line, progressing down the display.

Within each line of data, there are M items of data, each item of which is a digital representation of a pixel display state. Usually, within each line of data, the item of data corresponding to the left-most pixel in a row is input first and is followed by items of data corresponding to pixels progressing from left to right along the row.

The data are supplied to all of the pixels of the active matrix at a frequency known as the frame rate F. In order to achieve this, the data rate f must be greater than or equal to F.N.M. The (horizontal) line time, which is the period between consecutive horizontal synchronisation (HSYNC) pulses, must be less than or equal to 1/FN.

The waveforms illustrated in FIG. 2 of the accompanying drawings illustrate an example of the way in which digital signals are supplied to the digital data driver 2. The signal HSYNC is activated between each line of data and signifies the start of transmission of a line of data. Within each line of data, items D1, D2, . . . DM are transmitted serially.

Known types of monolithically integrated digital data drivers may be categorised into two main types depending on the time interval between when the digital data are transmitted and the corresponding analogue data are written to the data lines. The discrimination point is indicated by time tx in FIG. 2. If a line of data is written to the corresponding row of pixels before the time tx, the driving method is referred to as "point-at-a-time". If a line of data is written to the corresponding row of pixels after the time tx, the driving method is referred to as "line-at-a-time".

In line-at-a-time driving, in any one line time, the digital data driver may be sampling digital data for the current line while simultaneously converting the previous line of data from digital to analogue format and supplying the analogue data to the data lines. An advantage of this technique is that a whole line time is available (from when the last item DM of data is supplied until the next but one signal HSYNC) for digital/analogue conversion, writing analogue data to the data lines, and scanning the data from the data lines onto the electrodes of the row of pixels. This relatively large time period reduces the performance requirements of driver circuitry and particularly digital/analogue converter (DAC) circuitry, thus allowing implementation with lower performance processes. However, a disadvantage of this technique is that at least one entire line, and generally two entire lines, of digital data storage registers are required. Further, many DAC circuits are required. This in turn requires a relatively large physical area in the integrated circuit, particularly when the feature size of transistors is not very small as in the case of many poly-silicon TFT processes.

FIG. 3 of the accompanying drawings illustrates in block schematic form a known monolithically integrated digital data driver which is integrated on the same substrate as an active matrix using essentially the same processing steps. The driver comprises M input registers 10 which receive "single phase" digital data in parallel at a frequency of f and a clock at the frequency f. The input registers are connected to M storage registers 11, which thus receive "M phase" digital data at a frequency of f/M. The registers 11 supply the M phase digital data at the same frequency to M digital to analogue converters 12, which supply M phase analogue data at the same frequency to the active matrix 1.

The digital data are supplied at the frequency f in such a way that a complete line of data is sampled and stored in the input registers 10. Following storing of a complete line, all the digital data are transferred to the storage registers 11, which allows the input registers to sample and store the next line of data during the next line time while the data in the registers 11 are being converted by the converters 12 to analogue data, which are supplied to the data lines of the matrix 1. An arrangement of this type is disclosed in Y. Matsueda, T. Ozawa, M. Ximura, T. Itoh, K. Nakazawa, and H. Ohsima, "A 6-bit colour VGA low-temperature poly-Si TFT-LCD with integrated digital data drivers". Society for information Display 98 Digest, pages 879–882, 1998, which also indicates the large amount of substrate area required for such an arrangement. In fact it has not been possible to implement such an arrangement on only one side of the active matrix substrate. Instead, "tops" and "bottom" digital drivers are connected to intedigitated sets of data lines. A further problem with this arrangement is the difficulty in matching the performance of the converters 12.

FIG. 4 of the accompanying drawings illustrates a known modified type of digital data driver which is also integrated on the same substrate as the active matrix using essentially the same processing steps and which attempts to reduce the required area and minimise the number of transistors by multiplexing and demultiplexing around the DACs 12. The outputs of the storage registers 11 are connected to an M to m phase multiplexer 13, which selects m of the register outputs at a time and supplies these to m DACs 12, where m is less than M. This operation is repeated M/m times per line time so that all M "units" of data are converted to analogue form during each line time.

The outputs of the DACs are connected to an m to M phase demultiplexer 14, which routes the output of each DAC to drive the appropriate data line of the matrix 1. As shown in FIG. 5 of the accompanying drawings, the output of each DAC 12 is connected to a demultiplexing arrangement of the demultiplexer 14 which selectively connects the DAC output in turn to a set of data lines 5 which are physically adjacent each other in the active matrix 1. In the arrangement illustrated in FIG. 5, M/m is equal to 4. Arrangements of this type are disclosed in M. Osame, M. Azami. J. Koyama, Y. Ogata, H. Ohtani, and S. Yamazaki, "A 2–6-in. poly-Si TFT-LCD HDTV display with monolithic integrated 8-bit digital data drivers". Society for Information Display 98 Digest, pages 1059–1062, 1998, U.S. Pat. No. 5,170,158 and EP 0 938 074.

FIG. 6 of the accompanying drawings illustrates a known type of point-at-a-time digital data driver which is integrated on the same substrate as the active matrix using essentially the same processing steps and in which the analogue data are supplied to the data lines of the matrix 1 before the next line of digital data is transmitted to the driver. In this arrangement, there are m input registers 10, m storage registers 11, m digital to analogue converters 12 and an m to M phase demultiplexer 14. This arrangement has the advantage that, because the digital data are converted quickly, the total amount of digital storage is relatively small. However, this requires that the digital to analogue conversion take place-relatively quickly.

Each of the m input registers 10, the m storage registers 11 and the m DACs 12 operate M/m times per line time and each of the DACs drives M/m data lines via the m to M phase demultiplexer.

The DAC s 12 drive the data lines which are physically "local" to their outputs in the way illustrated in FIG. 5 of the accompanying drawings. Accordingly, off-panel data manipulation is required in order to reorder the input data and this is illustrated by the data reordering unit 15 in FIG. 6. For example, if M=16 and m=4, the data are transmitted in the sequence D1, D5, D9, D13, D2, D6, D10, D14, D3, D7, D11, D15, D4, D8, D12, D16. This type of arrangement is disclosed in JP 11038946, GB 2 327 137 and EP 0 837 446 and thus has the disadvantage of requiring the additional off-panel circuitry.

Y. Hanazawa, H. Hirai, K. Kumagai, K. Goshoo, H. Nakamura and J. Hanari, "A 202 ppi TFT-LCD using Low Temperature pol-Si Technology", proceedings of EuroDiplay '99, pp 369–372, 1999 discloses a low temperature poly-silicon LCD which comprises an active matrix connected by an array of switches to a plurality of bus lines. The switches are controlled so as to connect sets of adjacent data lines of the active matrix in turn to the bus lines.

The bus lines are connected to off-panel circuitry for supplying in turn sets of analogue signals for the sets of data lines. The off-panel circuitry comprises a controller which receives the input video data and supplies this to a set of digital/analogue converters whose outputs are connected to the bus lines.

EP 0 929 064 discloser an arrangement which comprises a set of line circuits connected to a common input. Each line circuit has a DAC whose output is demultiplexed to several near but non-adjacent data lines. This arrangement gives more conversion time to the DACs with minimum digital storage of the pixel data.

EP 0 458 169 is concerned with reducing the number of switches within the DACs by one corresponding to the least significant bit. The pixel updating phase is divided into two sub-phases. In the first sub-phase, data without its least significant bit are used to refresh the pixel. In the second sub-phase the some digital data are reapplied but with the least significant bit added to the next least significant bit so that the average field across the pixel is that which would have been supplied if the whole data word had been converted. This requires one DAC per data line.

JP 8 137 446 is concerned with an arrangement in which the pixel data for each horizontal line are initially reordered. The pixel words are then applied one at a time to a single DAC. The data lines are then addressed by decoding in the new order to switch the output of the DAC to each appropriate data line in turn.

SUMMARY OF THE INVENTION

According to the invention, there is provided an active matrix display comprising an active matrix and a digital data driver formed on a common substrate by a common integration process, the active matrix having M data lines and the driver comprising m registers forming at least one set for storing display data for m picture elements, where m is less than M, and m digital/analogue converters arranged to receive the display data from the m registers, respectively, characterised by m bus lines for receiving from the m converters, respectively, analogue signals representing desired picture element states, and a switching network for connecting in turn groups of m physically adjacent ones of the data lines to the m bus lines, respectively.

The registers may form one set and m may be greater than or equal to 2 and less than or equal to M/2. For example, m may be equal to 6. M.modulo.m may be non-zero and the switching network may be arranged to connect a further group of M.modulo.m physically adjacent ones of the data lines to M.modulo.m of the bus lines, respectively.

The registers may comprise n sets of m/n registers, where n is less than m, each set being arranged to store display data for a respective colour component. For example n may be equal to 3. m may be equal to 18. M.modulo. (m.n) may be non-zero and the switching network may be arranged to connect a further group of M.modulo. (m.n) physically adjacent ones of the data lines to M.modulo.(m.n) of the bus lines, respectively.

The or each set may comprise a first shift register for enabling the registers of the set in turn. The or each set may comprise i registers which are enabled in turn from one to i, each of the $1^{st}$ to (i–1)th registers comprising an input register enabled in turn from one to (i–1) and an output register enabled in synchronism with the ith register. Each of the input and output registers may have a storage capacity of a single pixel data word.

The switching network may comprise a plurality of groups of switches, the switches of each group being arranged to switch in synchronism to connect the bus lines to the respective group of the data lines. The driver may comprise a second shift register whose stages are arranged to control respective ones of the groups of switches. The second shift register may be arranged to be clocked by a stage of the first shift register.

The matrix may be a liquid crystal display matrix.

The driver and the matrix may be formed of poly-silicon thin film transistors.

The driver may be formed on one side of the substrate. The active matrix may be formed on the one side of the substrate.

It is thus possible to provide a display having a digital data driver which is relatively compact in terms of substrate area when monolithically integrated with an active matrix and which is capable of driving such a matrix sufficiently rapidly while being embodied by poly-silicon TFTs. In fact, it has been surprisingly found that poly-silicon DAC circuits are capable of driving loads represented by bus lines which traverse the entire length of the driver and hence the entire width of the active matrix in addition to the load represented by each data line of the matrix. Far fewer components are required and this results in lower power consumption, improved manufacturing yield and reduced display bezel size. An entire digital data driver may be implemented on one side of the display and the reduced area results in electronic components which are more uniform. Thus, the accuracies of the digital/analogue converters may be improved and this provides better image quality. The switching network may be embodied as a multi-phase analogue driver, which represents a substantial proportion of the data driver and which may be embodied using existing implementations, thus reducing the cost of design and manufacture and making use of efficient implementations.

BRIEF DESCRIPTION OF THE DRAWINGS

The invention will be further described, by way of example, with reference to the accompanying drawings, in which:

FIG. 9, which comprises FIG. 10, Which comprises

DESCRIPTION OF THE PREFERRED EMBODIMENTS

Figure 1:
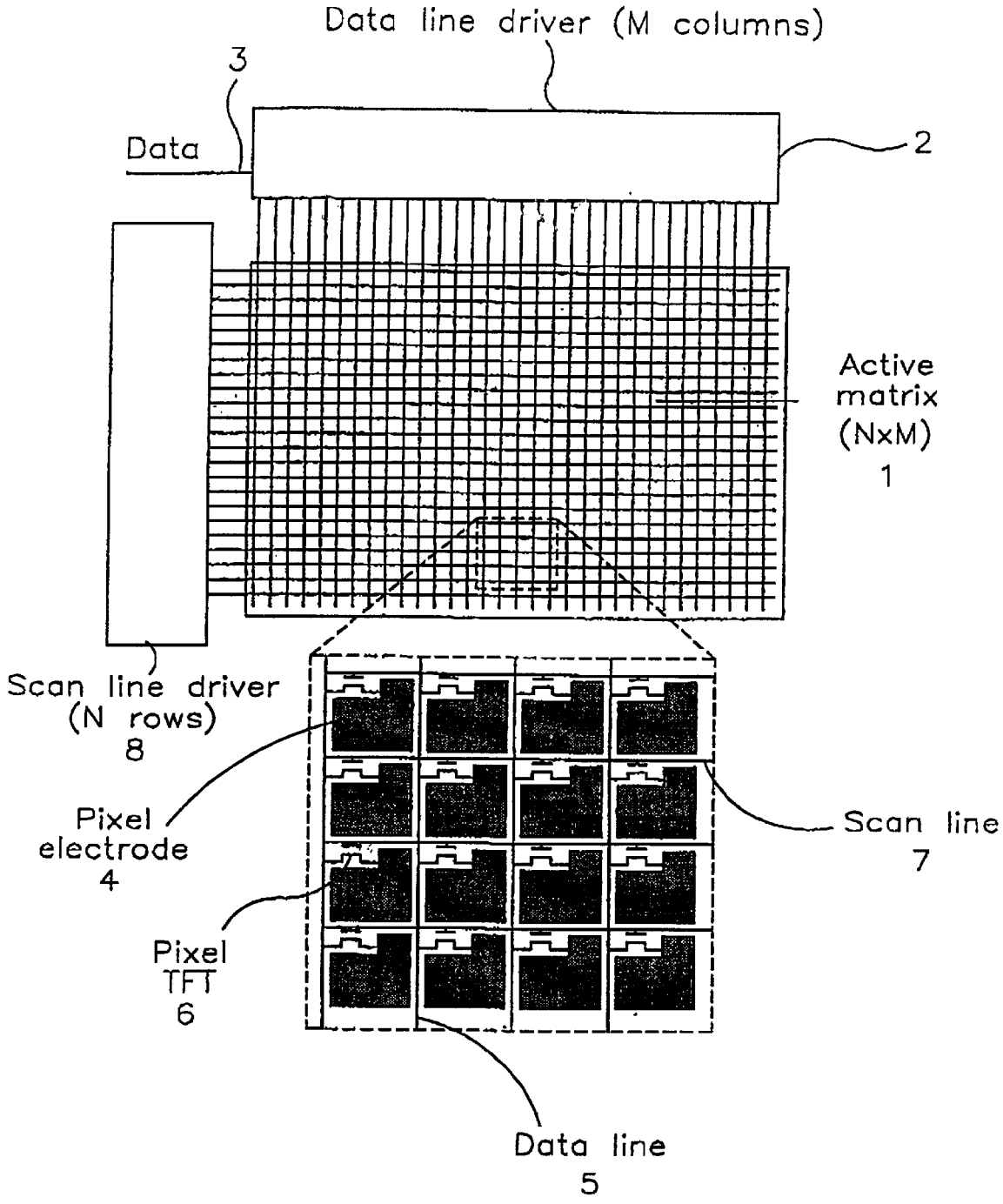
FIG. 1 is a schematic diagram illustrating a known type of active matrix display.

Throughout the drawings, like reference numerals refer to like parts.

Figure 2:
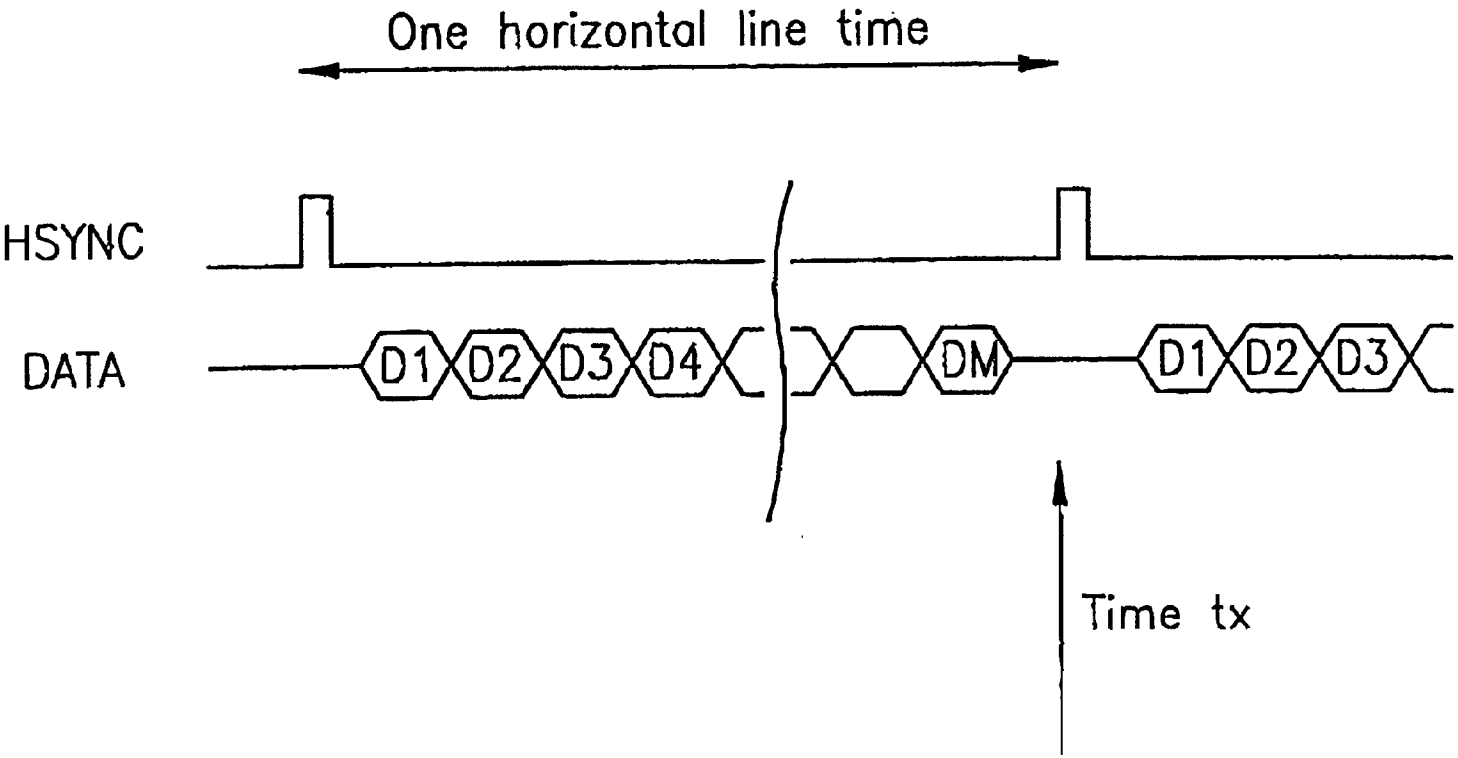
FIG. 2 is a waveform diagram illustrating the relationship between horizontal synchronising signals and items of display data.
Figure 3:
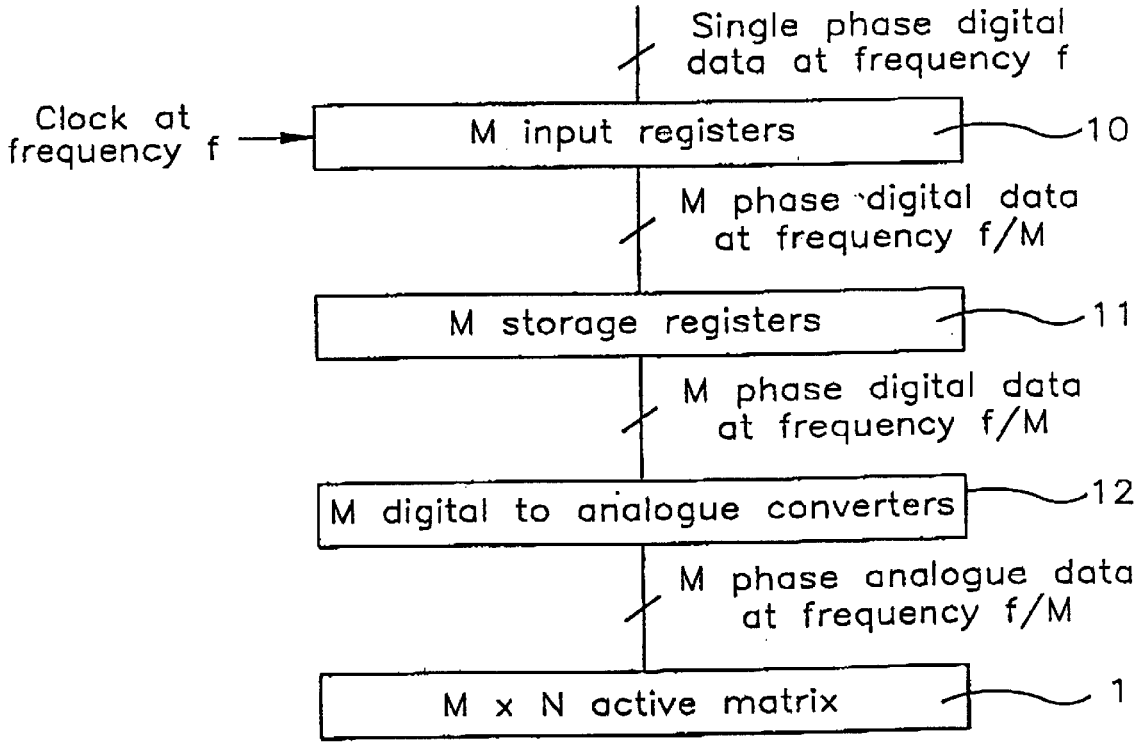
FIG. 3 is a block schematic diagram of a known monolithic digital data driver.
Figure 4:
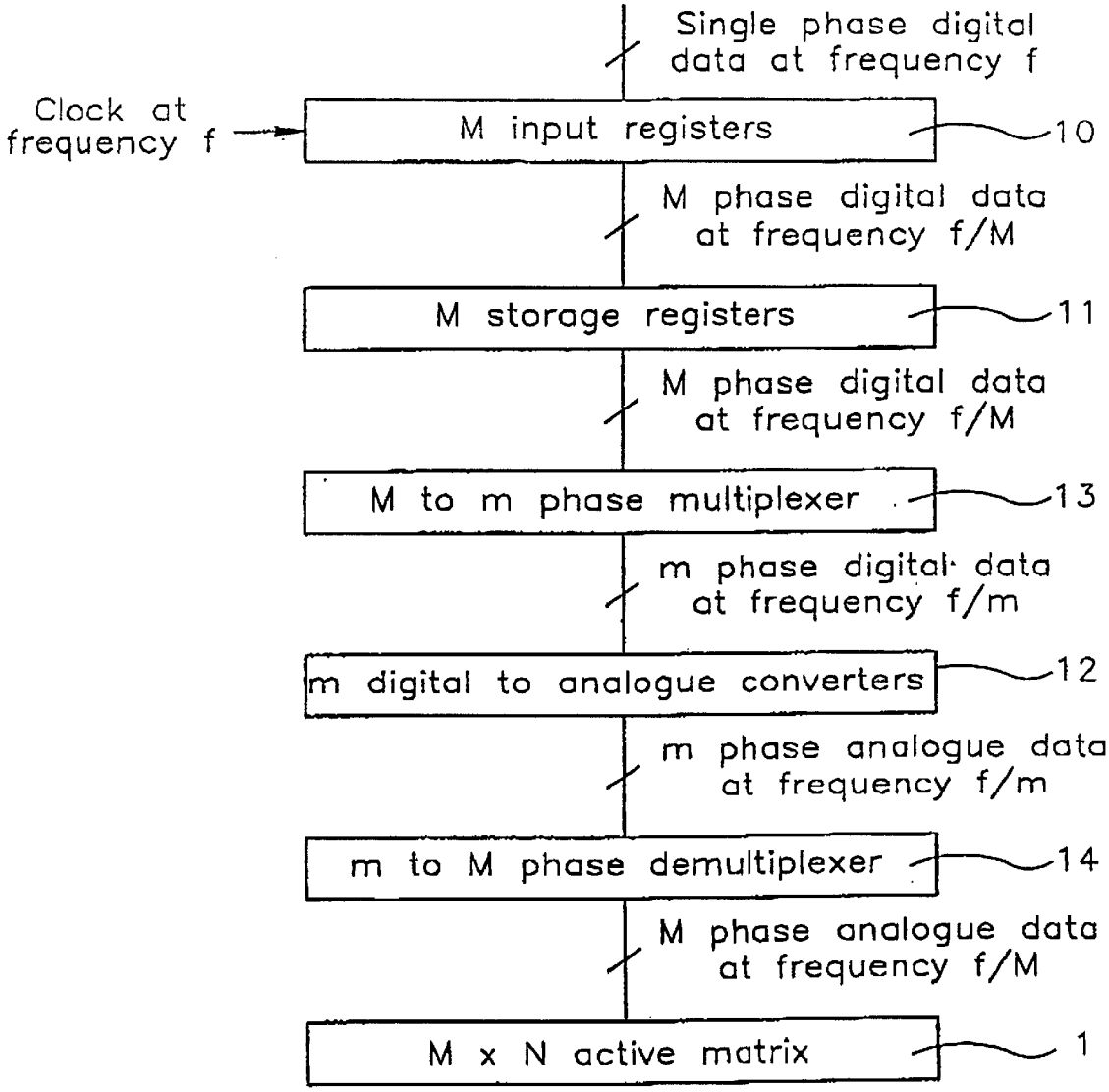
FIG. 4 is a block schematic diagram of another known monolithic digital data driver.
Figure 5:
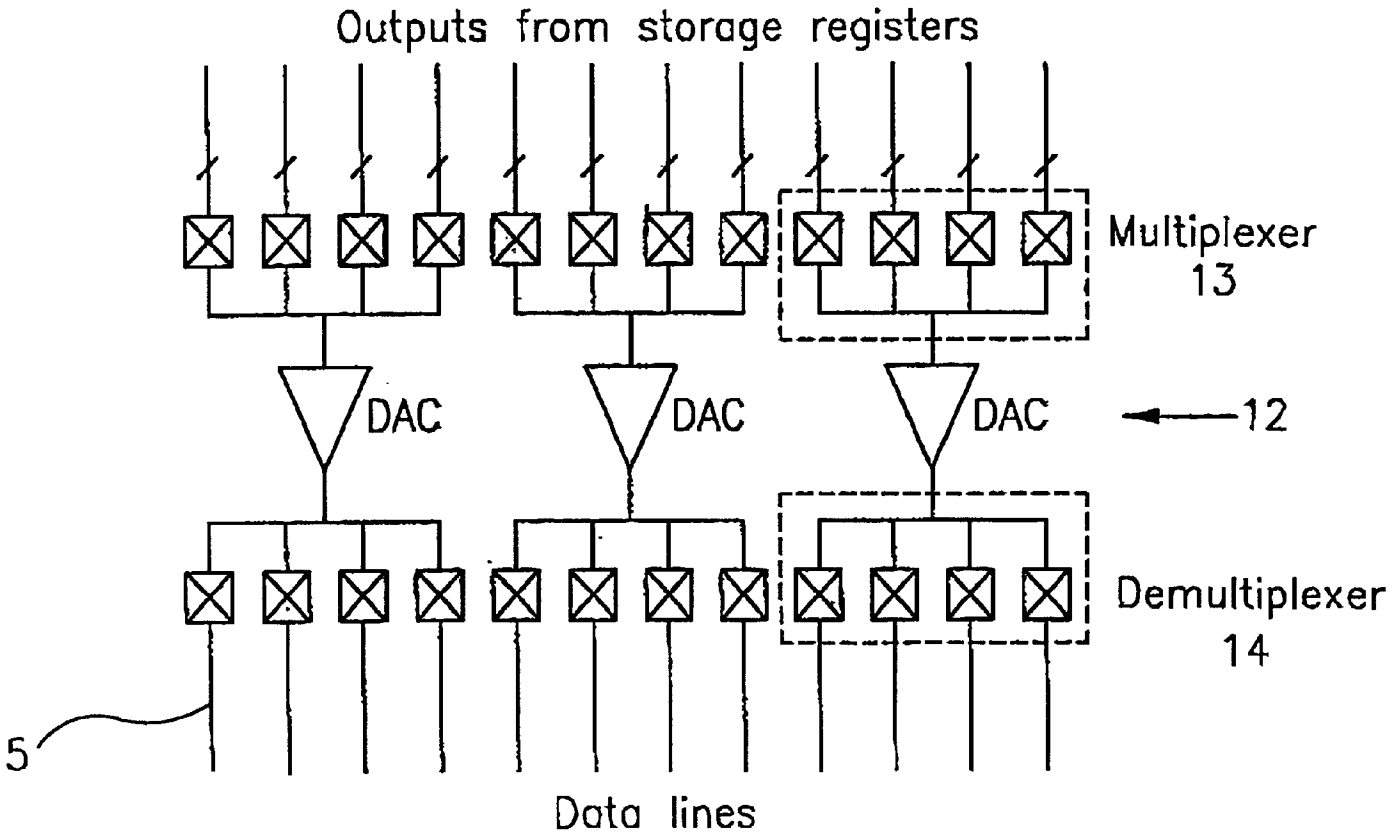
FIG. 5 is a block circuit diagram illustrating part of the driver of FIG. 4.
Figure 6:
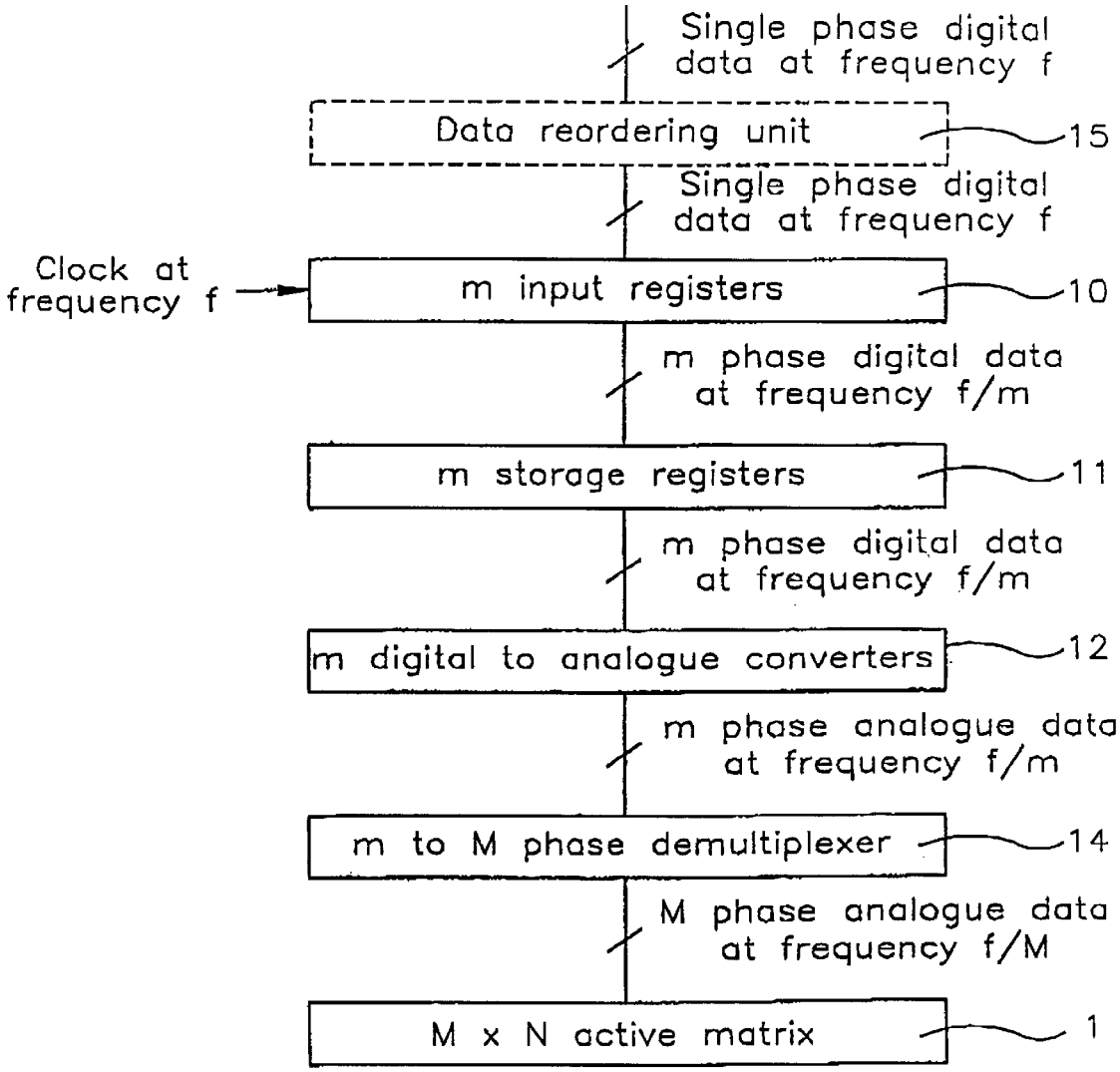
FIG. 6 is a block schematic diagram of a further known monolithic digital data driver.
Figure 7:
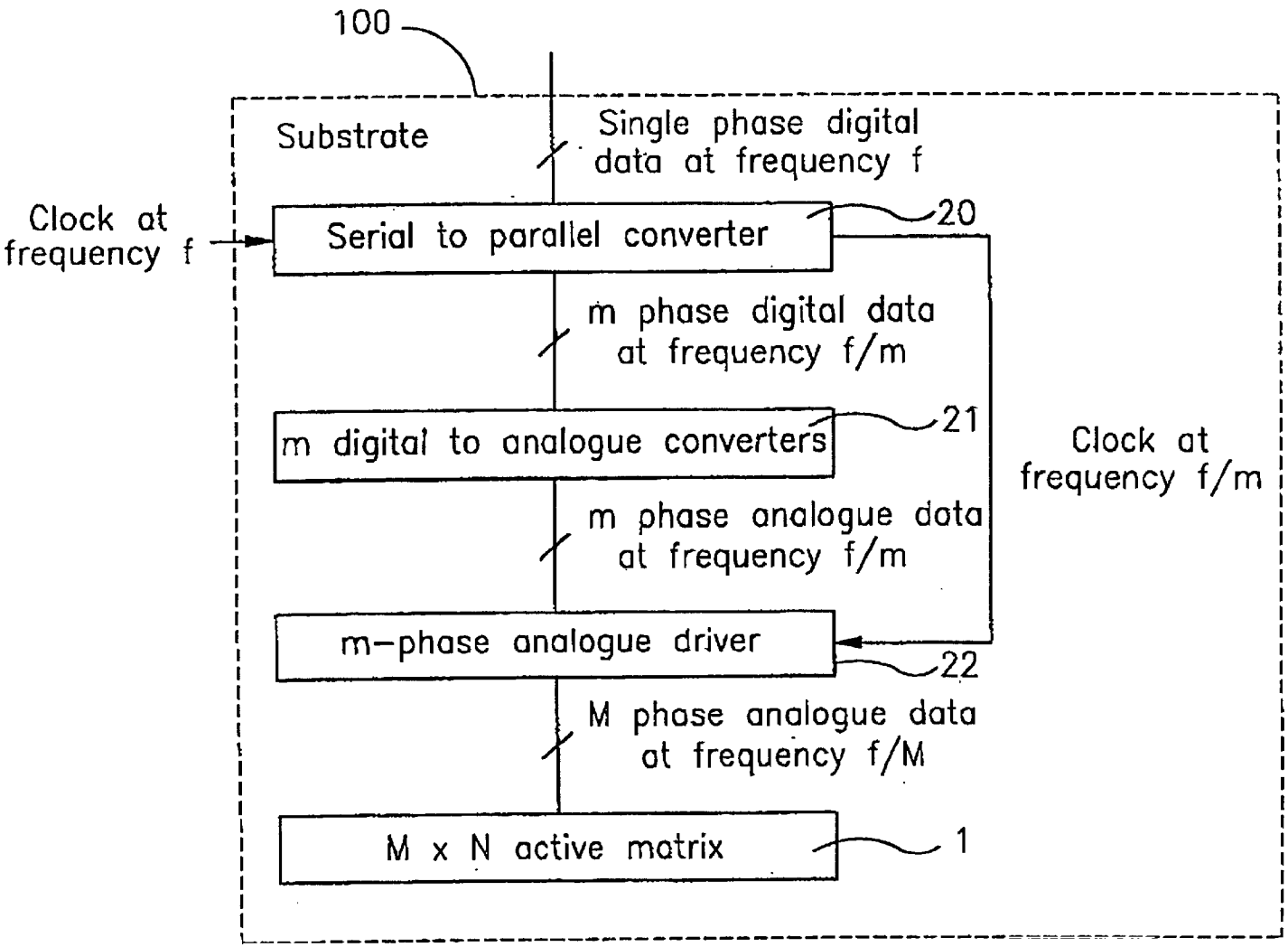
FIG. 7 is a block schematic diagram of an active matrix display including a monolithic digital data driver and constituting a first embodiment of the invention.

The display shown in FIG. 7 is arranged to receive single phase digital data at a frequency f and in the format illustrated in FIG. 2. The display comprises an M×N active matrix 1 and a digital data driver formed on the same side of a common, substrate 100 by means of a common integration process. For example, the matrix 1 and the driver may comprise high temperature or low temperature poly-silicon thin film transistors integrated using essentially the same processing steps, possibly differing in that the driver comprises CMOS transistors whereas the matrix comprises NMOS transistors.

The driver comprises a serial to parallel converter 20 which receives the single phase digital data and a clock at the frequency f and converts the data to m phase digital data at a frequency of f/m. The outputs of the converter 20 are supplied to the inputs of m digital to analogue converters 21, which convert the digital data to m phase analogue data at a frequency f/m. The analogue data are supplied to an m phase analogue driver 22 which receives a clock at the frequency f/m from the converter 20 and which supplies m phase analogue data at a frequency f/M to the M×N active matrix 1.

The converter 20 converts each group of m items of data to m phase parallel digital data which are converted to the corresponding analogue data by the converters 21. Each of the m converters converts the item of digital data at its input to an analogue voltage which is suitable for driving pixel electrodes of the matrix 1. The converters may, for example, perform non-linear digital-to-analogue conversion in order to compensate for the non-linear voltage/light-transmission characteristics of the pixels ("gamma correction").

The converters 21 may be of any suitable type. For example, in the case of relatively small displays of low grey scale resolution, for example 3 or 4 bits, each converter may comprise a decoder circuit which selects reference voltages to drive the corresponding data line. Alternatively, unbuffered parallel (binary weighted capacitor) circuits may be used to charge the data lines by charge sharing. In a further alternative, conversion is performed by using a sampled ramp scheme based on an analogue comparator circuit. For high performance displays, the data lines may be charged through additional buffers. Typically, such buffers are used with parallel converters based on binary weighted capacitors or resistor chains.

In the present case where the converters are required to charge bus lines or "video lines" in addition to the data lines, each of the converters 21 may include a high drive buffer.

The m phase analogue driver 22 is controlled by the clock generated in the converter 20 and generates M/m sampling pulses suitable for sampling data at the frequency f/m. Each sampling pulse is used to close a group of m switches which connect the m bus lines or video lines to m physically adjacent data lines of the active matrix 1. The data lines are thus charged to the same potentials as the bus lines. There are M/m groups of switches and, during a single line time, each group of m switches is closed once so that all M data lines are charged within the line time period. Thus, by the beginning of the next line time (illustrated as tx in FIG. 2) all of the data lines have been charged to the desired voltages.

Figure 8:
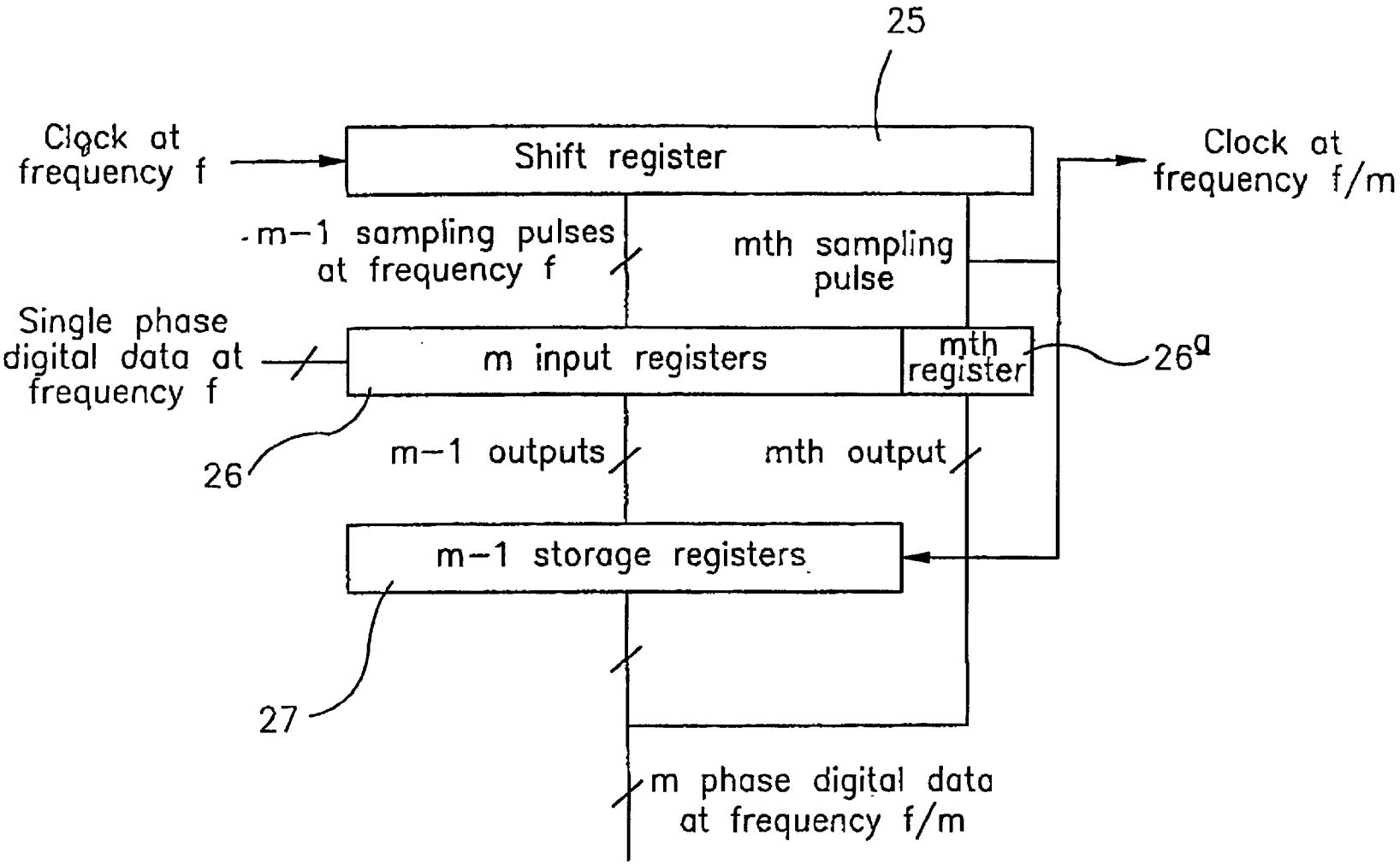
FIG. 8 is a block schematic diagram illustrating part of the driver of FIG. 7 in more detail.

An embodiment of the serial to parallel converter 20 is illustrated in more detail in FIG. 8. The converter comprises an m stage shift register 25, m input registers 26 and (m−1) storage registers 27. The converter is controlled by the clock of frequency f, which recirculates a single "1" state in the shift register. Each of the m stages of the shift register 25 in turn supplies a sampling pulse to a corresponding one of the m input registers, which thus sample and store m items of the single phase digital data.

The outputs of the first (m−1) input registers are connected to the inputs of (m−1) storage registers 27, whose outputs together with the output of the nth register 26*a* of the input registers 26 form the outputs of the serial to parallel converter 20.

The m sampling pulses from the shift register of each cycle of serial to parallel conversion cause the input registers 26 to sample and store m items of digital data. The mth sampling pulse causes the mth register 26*a* to sample the last item and simultaneously causes the (m−1) storage registers 27 to receive and store the outputs of the other registers. Thus, the converter outputs supply m phase digital data at the frequency of f/m at the converter outputs. The mth sampling pulse is also supplied as the clock to the driver 22.

The driver 22 operates as a switching network having m bus lines connected to the outputs of the m converters 21. Groups of physically adjacent data lines of the matrix 1 are connected to the m bus lines a group at a time with the timing controlled by the clock from the converter 20.

Figure 9A:
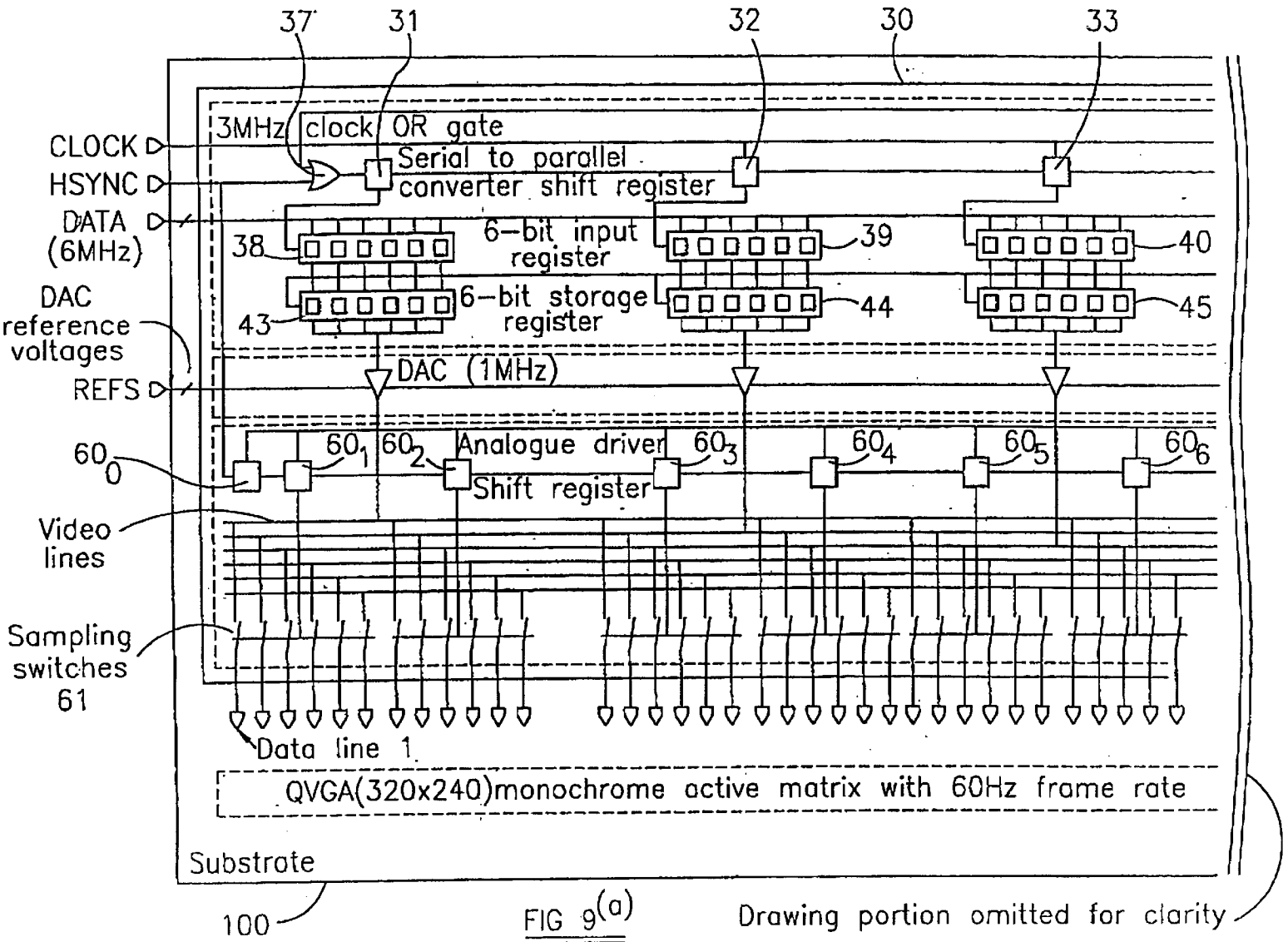
FIGS. 9*a* and 9*b*, is a circuit diagram of the driver shown in FIG. 7.
Figure 9B:
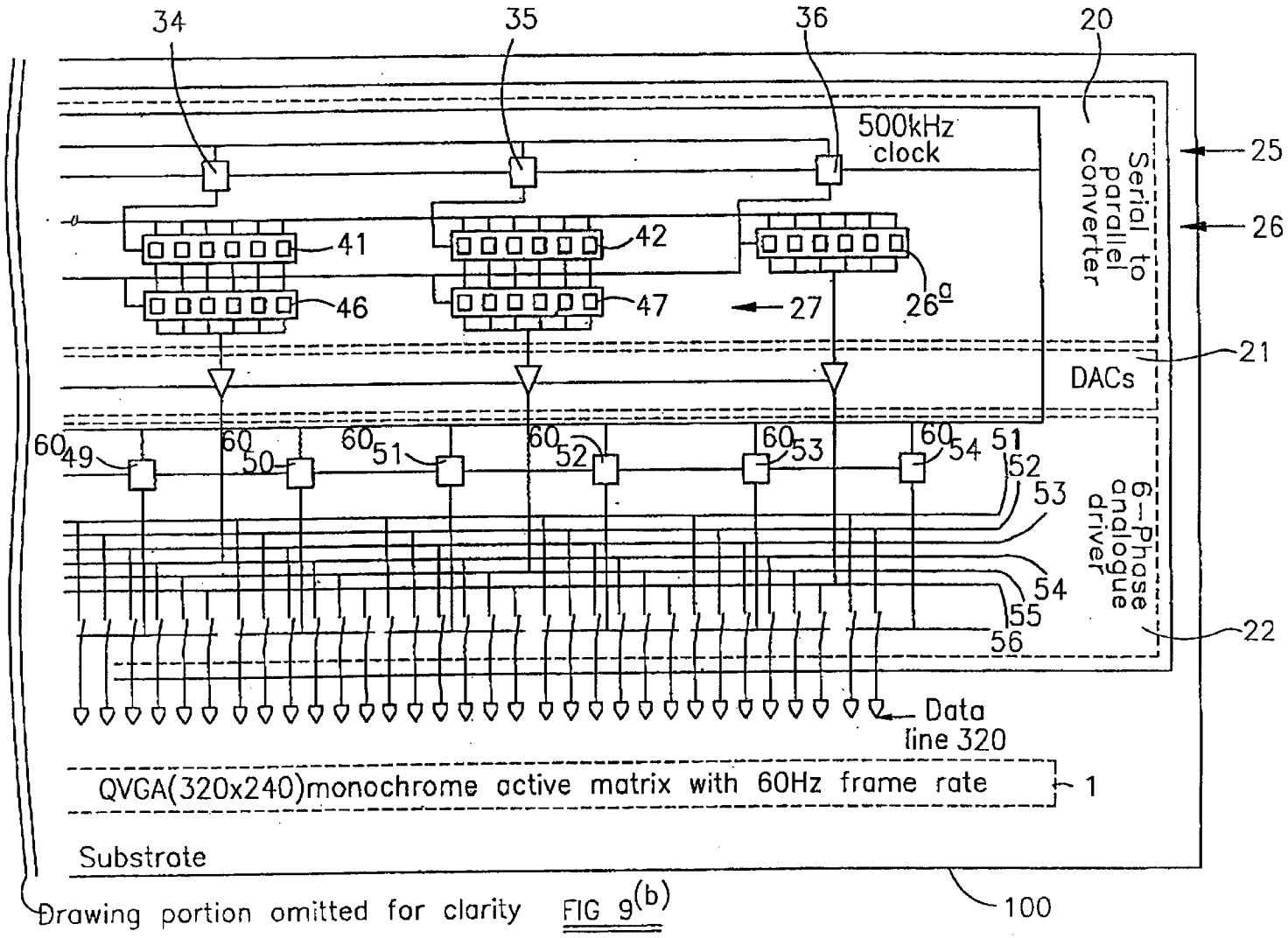

FIG. 9 illustrates in more detail the digital data driver shown in FIGS. 7 and 8. In particular, a specific example is shown for driving a 6-bit monochrome quarter-VGA (QVGA) active matrix of liquid crystal type comprising 320 columns by 240 rows. The driver 30 thus has 320 data line outputs for driving the corresponding data lines of the matrix 1 but not all of these are shown for the sake of clarity.

The driver 30 is controlled by clock signals CLOCK and horizontal synchronisation signals HSYNC and supplies image data to the active matrix data lines in accordance with a 6-bit digital input DATA. The image data are supplied to the driver at a frequency of 6 MHz so that the matrix 1 can be addressed or "refreshed" at a frame rate of at least 60 Hz. Reference voltages REFS are also supplied to the display 30 for the DACs 21. In this particular example, M is equal to 320 and m is equal to 6.

The shift register 25 comprises a chain of six flip-flop circuits or stages 31 to 36 and an OR gate 37. Each of the flip-flop circuits 31 to 36 has a clock input connected to receive the clock signal CLOCK. The output of the last flip-flop circuit 36 is supplied to one input of the gate 37, whose other input receives the horizontal synchronisation signal HSYNC. The shift register contains a resetting arrangement (not shown) of conventional type for ensuring that all of the flip-flop circuits 31 to 36 are reset to the "zero" logic state before operation.

In accordance with known techniques, the clock signal supplied to the clock inputs of the flip-flop circuits 31 to 36 is at half the frequency of the data rate e.g. 3 MHz for a data rate of 6 MHz. This is common practice for analogue drivers because it minimises power consumption in the clock line and it is easy to generate 6 MHz sampling pulses from a 3 MHz clock, for example by "AND" ing adjacent master and slave outputs of a shift register comprising a chain of D-type flip-flops. Such a technique is disclosed in U.S. Pat. No. 4,785,297.

Operation of the converter 20 is initiated upon receipt of the first horizontal synchronisation pulse which is clocked into the first flip-flop circuit 31. Subsequent clock pulses recirculate this single "1" logic state around the shift register so as to generate the sampling pulses. The last flip-flop circuit 36 of the shift register generates a 500 kHz clock signal, which is supplied to the six phase analogue driver 22.

The input registers 26 comprise first to fifth registers 38 to 42 and the sixth or last register 26*a*. Each of these registers is six bits wide and has data inputs connected via a common six bit bus to receive the input digital data at a rate of 6 million "words" per second. The storage registers for the first five input registers are likewise six bits wide and are shown at 43 to 47. The outputs of the storage registers 43 to 47 and of the last input register 26*a* are supplied to respective ones of the DACs 21, which receive the reference voltages from a common reference voltage bus. The outputs of the DACs 21 are connected to respective bus lines or video lines 51 to 56 which extend along the whole length of the driver 30 and along the whole width of the matrix 1.

The analogue driver 22 is in the form of a switching network and comprises a shift register having an initial stage $\mathbf{60}_0$ and subsequent stages $\mathbf{60}_1$ to $\mathbf{60}_{54}$. The clock inputs of the individual flip-flop circuits $\mathbf{60}_0$ to $\mathbf{60}_{54}$ are connected to the output of the final stage 36 of the shift register 25 and the initial stage $\mathbf{60}_0$ has its input connected to receive the horizontal sync signals HSYNC. Each of the stages $\mathbf{60}_1$ to $\mathbf{60}_{54}$ controls a respective group of sampling switches, such as that indicated at 61 for the stage $\mathbf{60}_1$. The switches of each group are thus operated in synchronism by the corresponding stage of the shift register and connect the bus lines 51 to 56 to six physically adjacent data lines of the matrix 1. Thus, when the stage $\mathbf{60}_1$ is active, the first group 61 of sampling switches connects the bus lines 51 to 56 to the first to sixth data lines, respectively, of the matrix 1. When the next stage $\mathbf{60}_2$ of the shift register is active, the next group of switches connects the bus lines 51 to 56 to the seventh to twelfth data lines, respectively, of the matrix, and so on. Operation of the shift register is initiated upon receipt of a horizontal synchronisation pulse HSYNC and the "1" state is clocked through the shift register by the clock pulses from the final stage 36 of the shift register 25. The shift register also has a resetting arrangement (not shown).

At the start of each horizontal line period, the horizontal sync pulse HSYNC is supplied via the OR gate 37 to the first stage 31 of the shift register 25 and to the initial stage $\mathbf{60}_0$ of the shift register in the driver 22. The horizontal synchronisation pulse signals the start of transmission of the first data word and the first clock signal so that a logic level 1 is set in the flip-flop circuit 31, which enables the input register 38 to store the first word of data. The next clock pulse transfers the "1" state to the circuit 32, which thus enables the input register 39 to store the second word of image data, and so on until the fifth word is stored in the register 42.

When the next clock pulse is received in synchronism with the sixth data word, the "1" state is transferred to the circuit 36, which causes the sixth word to be stored in the final register 26*a* and simultaneously enables the transfer of the first to fifth words to the storage registers 43 to 47, respectively. The first six display data words are thus simultaneously supplied to the corresponding DACs 21 which convert the digital data to corresponding analogue data having voltages for causing the desired optical responses from the individual pixels of the line or row currently being addressed. The final stage 36 also supplies a clock pulse to the shift register within the analogue driver 22 and this transfers the "1" state from the stage $\mathbf{60}_0$ to the stage $\mathbf{60}_1$. The stage $\mathbf{60}_1$ closes the six sampling switches 61 so as to connect the first to sixth data lines of the matrix 1 to the bus lines 51 to 56, which are in turn connected to the outputs of respective ones of the DACs 21. The DACs are thus connected via the bus lines 51 to 56 to the first to sixth data lines, which are charged to the appropriate voltage levels.

The digital data in the registers 43 to 47 and 26*a* are held for six clock periods so that the DACs 21 have one microsecond in which to perform the digital/analogue conversion and to supply the corresponding analogue voltages to the data lines currently being addressed. During this period, the next six words of data are written into the registers 38 to 42 and 26*a*. The clock pulse from the final stage 36 then transfers the "1" state to the stage $\mathbf{60}_2$ of the analogue driver 22. The first group of switches controlled by the stage $\mathbf{60}_1$ are thus opened and the next group of switches controlled by the stage $\mathbf{60}_2$ are closed to connect the bus lines 51 to 56 to the seventh to twelfth data lines of the matrix 1.

This process is repeated until a complete line of data has been converted and transferred to the data lines of the matrix 1 so that a complete row of pixels is ready to be updated. Updating then occurs when a scan pulse is applied to the row of pixels. The process is then repeated upon receipt of the next horizontal synchronisatlon pulse.

As illustrated in FIG. 9, m does not have to be a factor of M. In the present case, M has the value 320 and m has the value 6. Thus, the final stage $\mathbf{60}_{54}$ of the shift register of the analogue driver 22 controls only two switches, which connect the bus lines 51 and 52 to the 319th and 320th data lines, respectively, of the matrix 1. More generally, one of the stages $\mathbf{60}_1$ to $\mathbf{60}_{54}$ (for convenience generally but not necessarily the final stage) connects M.modulo.m of the bus lines 51 to 56 to corresponding adjacent data lines of the matrix 1. In the present case, the analogue driver 22 requires 54 stages $\mathbf{60}_1$ to $\mathbf{60}_{54}$ in order to supply the 320 data lines of the matrix 1.

For a given process, the optimum number of phases m for the most efficient implementation of the digital data driver 30 depends on the speed at which the digital/analogue conversion operation can be performed and the speed at which the bus lines 51 to 56 and the data lines can be charged. The most transistor-efficient implementation is given by the minimum number of phases which still allow sufficient time for settled digital/analogue conversion operation and bus and data line charging. For typical low temperature poly-silicon thin film transistor (TFT) processes, between 4 and 16 phases are believed to be good choices. In the specific example described hereinbefore with six phases, one microsecond is available for digital/analogue conversion and bus and data line charging. Thus, six phases appear to be a good choice for many implementations of the digital data driver.

The digital data driver 30 of FIG. 9 is suitable for a monochrome display panel. However, the same techniques may readily be employed for a colour display panel and FIG. 10 is the circuit diagram of a digital data driver 30 which is suitable for addressing a six bit colour QVGA active matrix with an RGB stripe pixel format.

Figure 10A:
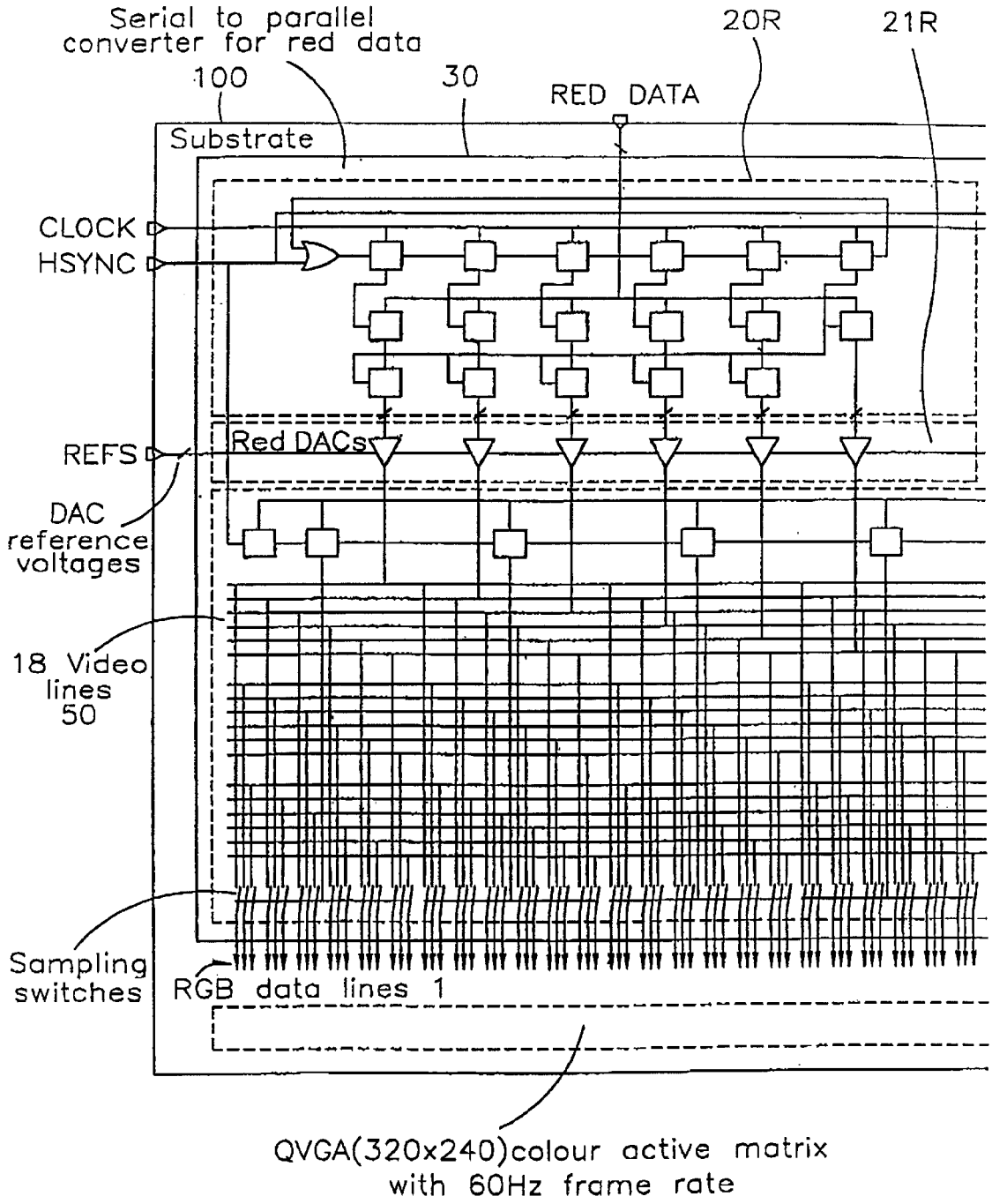
FIGS. 10*a*, 10*b* and 10*c*, is a circuit diagram of an active matrix display including a monolithic digital data driver and constituting a second embodiment of the invention.
Figure 10B:
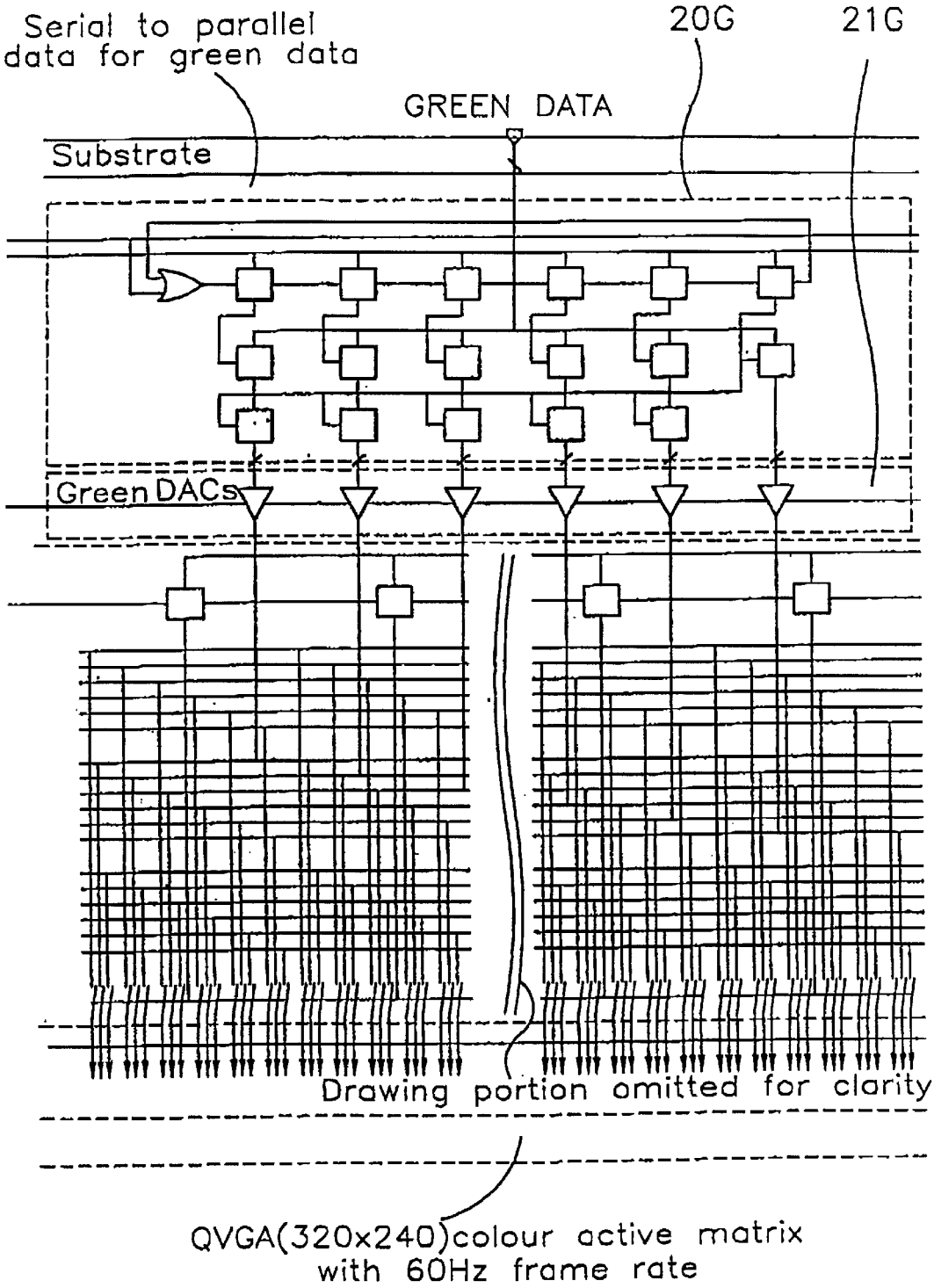
Figure 10C:
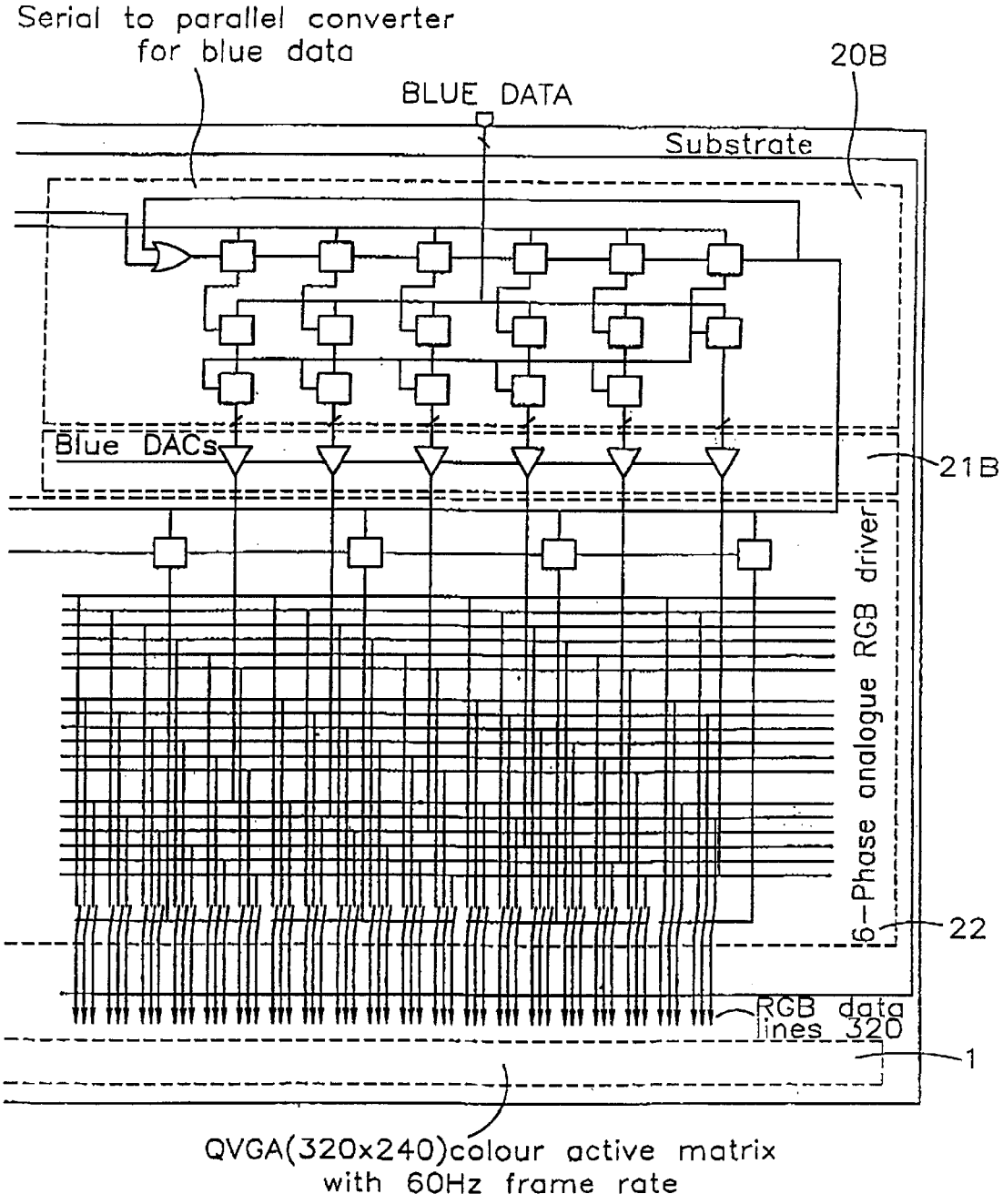

The data driver of FIG. 10 differs from that of FIG. 9 in that it comprises three serial to parallel converters 20R, 20G and 20B, each of which is connected to a respective set of DACs 21R, 21G and 21B. The display data for the red, green and blue pixels are supplied on three separate inputs simultaneously and in synchronism with the clock signals so that the colour component data are clocked into the input and storage registers simultaneously.

Also, instead of six bus lines or video lines, the digital display driver 30 of FIG. 10 replicates the six bus lines for each colour so that there is a total of 18 bus lines or video lines 50. Likewise, each stage except the final one of the shift register of the analogue driver 22 controls eighteen switches for connecting the red, green and blue bus lines to the physically adjacent red, green and blue data lines of each group of data lines of the matrix 1. The final stage controls six switches which connect the RGB data lines 319 and 320 to the first and second bus lines of the red, green and blue bus lines, respectively. The analogue driver thus functions as described hereinbefore with reference to FIG. 9 with its shift register being clocked by the final stage of one of the serial to parallel converter shift registers; in the present case, the final stage of the shift register for the blue colour component display data.

It is thus possible to provide a display having a digital data driver which is sufficiently compact in terms of the required monolithic integrated circuit area to be integrated on one side of the active matrix substrate while allowing relatively low performance transistors, such as poly-silicon TFTs, to be used.

What is claimed is:

1. An active matrix display comprising an active matrix and a digital data driver formed on a common substrate by a common integration process, the active matrix having M data lines and the driver comprising:

m registers forming at least one set for storing display data for m picture elements, where m is less than M, m digital/analogue converters arranged to receive the display data from the m registers, respectively, m bus lines for receiving from the m converters, respectively, analogue signals representing desired picture element states, and a switching network for connecting in turn groups of m physically adjacent ones of the data lines to the m bus lines, respectively, wherein in response to a predetermined clock pulse the display data from the at least one set of m registers is simultaneously supplied to the digital/analogue converters.

2. A display as claimed in claim 1, characterised in that the registers form one set and m is greater than or equal to 2 and less than or equal to M/2.

3. A display as claimed in claim 2, characterised in that m is equal to 6.

4. A display as claimed in claim 2, characterised in that M.modulo.m is non-zero and the switching network is arranged to connect a further group of M.modulo.m physically adjacent ones of the data lines to M.modulo.m of the bus lines, respectively.

5. A display as claimed in claim 1, characterised in that the registers comprise n sets of m/n registers, where n is less than m, each set being arranged to store display data for a respective colour component.

6. A display as claimed in claim 5, characterised in that n is equal to three.

7. A display as claimed in claim 6, characterised in that m is equal to 18.

8. A display as claimed in claim 5, characterised in that M.modulo.(m.n) is non-zero and the switching network is arranged to conned a further group of M.modulo.(m.n) physically adjacent ones of the data lines to M.modulo.(m.n) of the bus lines, respectively.

9. A display as claimed in claim 1, characterised in that the or each set comprises a first shift register for enabling the registers of the set in turn.

10. A display as claimed in claim 9, characterised in that the or each set comprises i registers which are enabled in turn from 1 to i, each of the 1st to (i−1)th registers comprising an in put register enabled in turn from 1 to (i−1) and an output register enabled in synchronism with the ith register.

11. A display as claimed in claim 10, characterised in that each of the input and output registers has a storage capacity of a single pixel data word.

12. A display as claimed in claim 1, characterised in that the switching network comprises a plurality of groups of switches, the switches of each group being arranged to switch in synchronism to connect the bus lines to the respective group of the data lines.

13. A display as claimed in claim 12, characterised by a second shift register whose stages are arranged to control respective ones of the groups of switches.

14. A display as claimed in claim 13 characterised in that the or each set comprises the first shift register for enabling the registers of the set in turn, in which the second shift register is arranged to be clocked by a stage of the first shift register.

15. A display as claimed in claim 1, characterised in that the matrix is a liquid crystal display matrix.

16. A display as claimed in claim 1, characterised in that the driver and the matrix are formed of poly-silicon thin film transistors.

17. A display as claimed in claim 1, characterised in that the driver is formed on one side of the substrate.

18. A display as claimed in claim 17, characterised in that the active matrix is formed on the one side of the substrate.

* * * * *